US012487014B1

(12) United States Patent
Coyle

(10) Patent No.: US 12,487,014 B1
(45) Date of Patent: Dec. 2, 2025

(54) BULBLESS THERMOSTATIC EXPANSION VALVE CONTAINING A THERMAL SEPARATION SLOT

(71) Applicant: Parker-Hannifin Corporation, Cleveland, OH (US)

(72) Inventor: Eric R. Coyle, Chesterfield, MO (US)

(73) Assignee: Parker-Hannifin Corporation, Cleveland, OH (US)

( * ) Notice: Subject to any disclaimer, the term of this patent is extended or adjusted under 35 U.S.C. 154(b) by 100 days.

(21) Appl. No.: 18/601,184

(22) Filed: Mar. 11, 2024

Related U.S. Application Data

(60) Provisional application No. 63/490,850, filed on Mar. 17, 2023.

(51) Int. Cl.
*F25B 41/335* (2021.01)

(52) U.S. Cl.
CPC .... *F25B 41/335* (2021.01); *F25B 2700/1933* (2013.01); *F25B 2700/21151* (2013.01)

(58) Field of Classification Search
CPC ..... F25B 41/332; F25B 2700/1933; F25B 2700/21151
See application file for complete search history.

(56) References Cited

U.S. PATENT DOCUMENTS

| | | | | |
|---|---|---|---|---|
| 10,557,648 | B2 | 2/2020 | Naito et al. | |
| 2023/0012455 | A1* | 1/2023 | Aoki | F25B 41/335 |

FOREIGN PATENT DOCUMENTS

| | | | |
|---|---|---|---|
| CN | 205244410 | A | 5/2016 |
| CN | 206377899 | A | 8/2017 |
| JP | 2000310461 | A | 11/2000 |
| JP | 2007033021 | A | 2/2007 |

* cited by examiner

*Primary Examiner* — Elizabeth J Martin
(74) *Attorney, Agent, or Firm* — Renner, Otto, Boisselle & Sklar, LLP

(57) ABSTRACT

A bulbless thermostatic expansion valve includes a valve body having an inlet and an outlet, a suction line that is fluidly isolated from the inlet and the outlet, a valve member movable relative to the valve body for controlling flow of an operating fluid through the valve body, and a power element mounted to the valve body adjacent to the suction line and that senses temperature and pressure of the suction line. To account for potential temperature variations among components of the valve and ambient variations, the valve body has a thermal separation slot that is positioned between the inlet and the suction line to provide thermal separation of the power element relative to the inlet. The valve body may have a second thermal separation slot that is positioned between the outlet and the suction line to provide thermal separation of the power element relative to the outlet.

8 Claims, 5 Drawing Sheets

BULBLESS THERMOSTATIC EXPANSION VALVE CONTAINING A THERMAL SEPARATION SLOT

RELATED APPLICATIONS

This application claims the benefit of U.S. Provisional Appl. No. 63/490,850 filed on Mar. 17, 2023, the contents of which are incorporated here by reference.

FIELD OF INVENTION

The present application relates to bulbless thermostatic expansion valves and related heat conduction control within such a valve.

BACKGROUND OF THE INVENTION

A thermostatic expansion valve (TEV) is a component of a vapor compression system (for example, a residential air conditioner system) that is used for refrigerant expansion and cooling. One type of TEV used in vapor compression systems is a bulbless thermostatic expansion valve (BTEV). BTEVs have been developed for use in a vapor compression system, with BTEVs being particularly suitable for residential air conditioner systems due to their more compact size and ease of installation. In general, a BTEV does not utilize an external thermostatic sensing bulb with a corresponding external capillary tube to sense temperature in the system at the refrigerant suction line, and thus all of the sensing fluid may be contained in a closed thermodynamic system in the sensor enclosure. The elimination of the bulb eliminates issues associated with poor attachment of the bulb on the suction line, which typically is accomplished with a metallic clamp often resulting in discontinuous contact with the suction line and results in the valve failing to control superheat as intended. The corresponding elimination of the capillary tube also eliminates issues with capillary tube breakage or charge migration in the capillary tube, such as due to condensation in the capillary tube. In addition, a bulbless configuration provides a relatively short path between the suction line and the power element, and thus issues such as clogging, unwanted cooling, and other deficiencies due to longer pathway are minimized.

In conventional BTEVs, the BTEV senses pressure and temperature of the system suction line using a power element. The power element reacts to changes in temperature and pressure measured on the suction line by opening or closing a valve member. An inlet of the valve body of the BTEV receives hot liquid refrigerant, and the refrigerant expands as the refrigerant flows through an orifice in the valve body. The amount of flow through the orifice is metered by the valve member as controlled based on the sensor measurements taken off the suction line, and this flow through the orifice causes expansion and the temperature of the refrigerant becomes colder. The refrigerant is then routed through a valve outlet to a heat exchanger, where the refrigerant gains temperature and is returned to the valve through a second passage through the valve body that operates as a suction line passage for flow to the compressor. The system optionally may include a fan to add airflow over the valve from the heat exchanger. The power element is attached adjacent to the suction line that extends through the valve body so that the power element can sense and react to the pressure and temperature of the suction line.

In a conventional configuration, the valve body of the BTEV thus defines the suction line passage, valve inlet, and valve outlet, which all can be at different temperatures. The valve body further is exposed to the ambient temperature. The valve body, being exposed to these various temperatures, effectively operates to average out these temperatures and conducts the resultant heat to the power element. This heat conduction raises or otherwise affects the temperature of the power element and may cause the temperature of the power element to be different from the temperature of the suction line that specifically is to be sensed and measured, and, therefore, the power element of the BTEV may position the valve member to an incorrect position for superheat control. This causes inefficiency of the system by allowing too much or too little refrigerant flow through the BTEV and may result in the BTEV over-correcting or hunting for proper valve member positioning.

SUMMARY OF INVENTION

There is a need in the art, therefore, for a configuration of a bulbless thermostatic expansion valve (bulbless TEV) that maintains accurate reading of temperature at the suction line despite temperature variations that occur at different portions of the valve body, including in response to variations of ambient temperature. To provide an enhanced configuration, in embodiments of the present application the valve body of the bulbless TEV defines the suction line, valve inlet, and valve outlet, which all can be at different temperatures. The valve body further is exposed to the ambient temperature which also varies. A conventional valve body averages out these temperatures and conducts this heat to the power element. To account for temperature variations, the valve body of the of the bulbless TEV of the present application further has or defines a thermal separation slot that is incorporated within the valve body. The thermal separation slot preferably is positioned between the inlet, which receives the flow of hot refrigerant, and the suction line. The thermal separation slot insulates the suction line from the hot liquid refrigerant that is flowing through the inlet. In this manner, the thermal separation slot is positioned between the inlet and the suction line on an inlet side of the valve body to provide thermal separation of the suction line relative to the inlet.

The thermal separation slot effectively decreases the amount of heat that is transferred from the inlet to the suction line, and therefore also to the power element, thereby minimizing the propensity of the power element to operate based on an incorrect temperature. As a result, the valve body with the thermal separation slot positioned between the inlet and the suction line on an inlet side of the valve body provides thermal separation of the power element relative to the inlet. Further in this regard, the thermal separation provided by the thermal separation slot also minimizes the effects of ambient temperature variation on the temperature sensed by the power element.

In another embodiment, the bubless TEV includes a second thermal separation slot. In particular, the valve body further has or defines the second thermal separation slot that may be incorporated into the valve body positioned between the suction line and the valve outlet. In this manner, the second thermal separation slot is positioned between the outlet and the suction line on an outlet side of the valve body to provide thermal separation of the suction line relative to the outlet. As a result, the valve body with the second thermal separation slot that is positioned between the outlet and the suction line on an outlet side of the valve body provides thermal separation of the power element relative to the outlet. As referenced above, the hot refrigerant typically is received at the valve inlet and expands and cools due to the operation of the valve member. Accordingly, the temperature of the refrigerant on the inlet side is elevated relative to the temperature on the outlet side. The first thermal separation slot on the inlet side thus provides the gravamen of the thermal isolation or separation, but the second thermal separation slot optionally can be added to provide some improved thermal isolation or separation as the temperature at the valve outlet still may vary relative to the temperature of the suction line, and also to better minimize the effects of ambient temperature variations.

To provide support and robustness where the refrigerant flow conduits connect to the valve body, the bubless TEV may include a flange portion. Accordingly, the flange portion may provide another pathway from which there may be varying temperature exposure to the valve body, which in turn may result in temperature variation conducted to the power element. In another exemplary embodiment, to reduce the potential for heat conduction from the flange portion to the valve body, and ultimately to the power element, the bulbless TEV further may include a thermal gasket positioned between the valve body and the flange portion. In this manner, the thermal gasket operates to provide thermal separation of the valve body relative to the flange portion. The thermal gasket may be made of any suitable material to provide the requisite thermal separation. The thermal gasket may be used in either configuration of thermal separation slots, i.e., used with the embodiment employing the single thermal separation slot on the inlet side, or used with the embodiment employing two thermal separation slots with one each respectively being positioned on the inlet side and the outlet side.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DESCRIPTION

Figure 1:
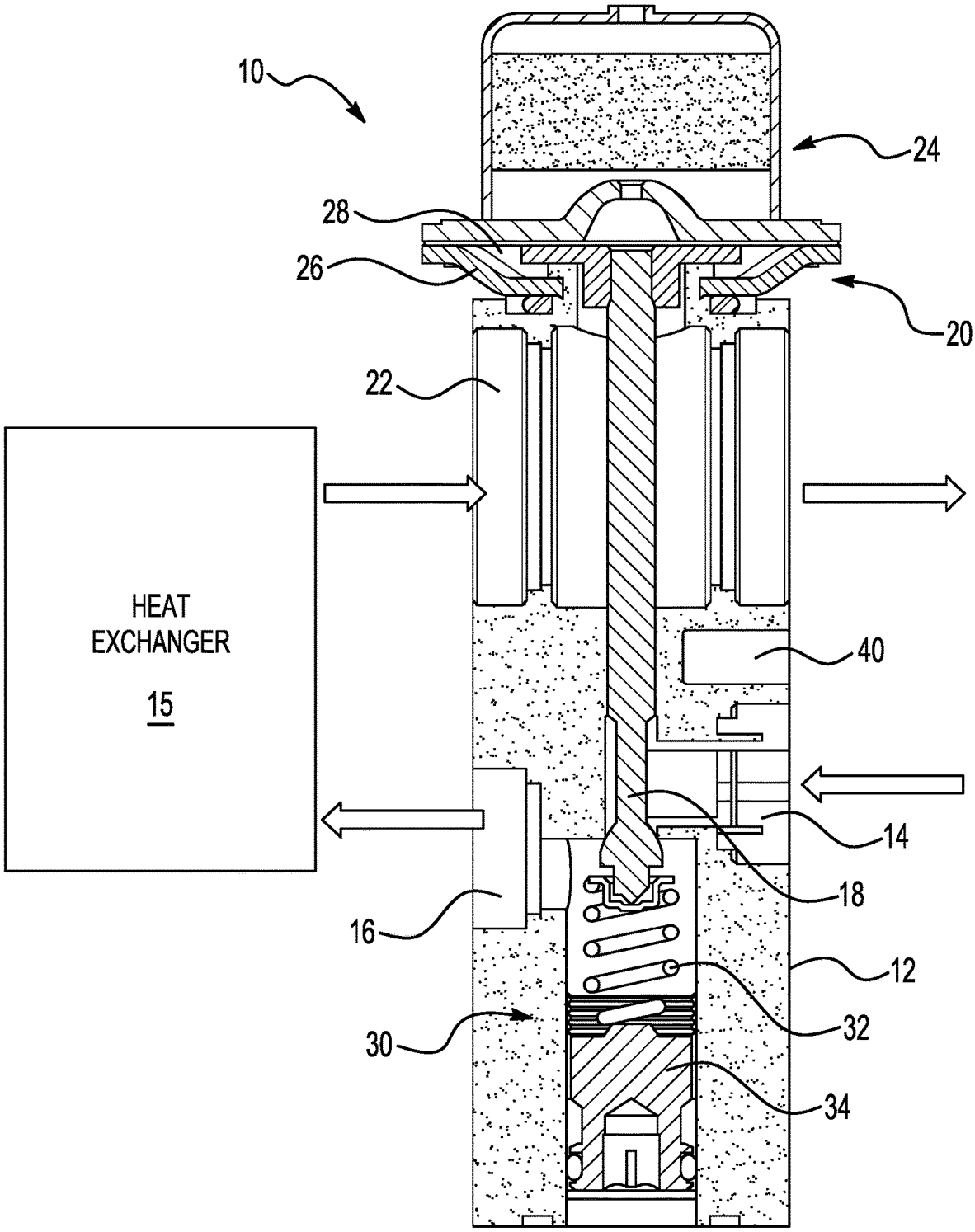
FIG. 1 is a drawing depicting a cross-sectional view of an exemplary embodiment of a bulbless TEV according to the present application.

Embodiments of the present application will now be described with reference to the drawings, wherein like reference numerals are used to refer to like elements throughout. It will be understood that the figures are not necessarily to scale.

Figure 2:
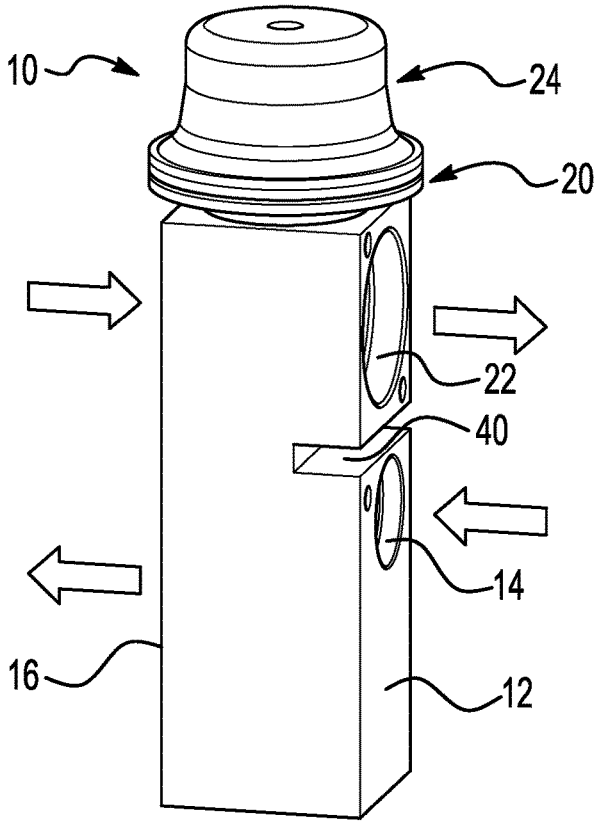
FIG. 2 is a drawing depicting a perspective view of the exemplary bulbless TEV of FIG. 1.

FIG. 1 is a drawing depicting a cross-sectional view of an exemplary embodiment of a bulbless TEV 10, and FIG. 2 is a drawing depicting a perspective view of the exemplary bulbless TEV 10 of FIG. 1. The TEV 10 includes a valve body 12 having an inlet 14 and an outlet 16. The inlet and outlet 14 and 16 are fluid passages through the valve body 12 along the common liquid line that runs to a heat exchanger 15. The valve body 12 houses a valve member 18 that is coupled to a power element 20 for controlling operation of the valve member to thereby control flow of operating fluid through the valve body 12. The TEV further is coupled to a suction line 22 through which the refrigerant ultimately is suctioned into a compressor (not shown), and the suction line 22 is fluidly separated or isolated from the inlet and the outlet. The arrows in FIGS. 1 and 2 (and also in subsequent figures) denote the flow of refrigerant through the valve body into the inlet 14 and out from the outlet 16, and into and out from the suction line 22. The TEV 10 includes a thermal sensor 24 operatively mounted to the power element 20, and the thermal sensor includes a sensor enclosure that at least partially forms a sensing chamber that contains a sensing fluid. The valve member 18 is movable relative to the valve body 12 in response to actuation by the power element 20 to control operating fluid flow through a flow path between the inlet 14 and the outlet 16 that is part of the common liquid line that fluidly connects the heat exchanger.

The valve member 18 may have any suitable valve structure, such as for example a poppet valve or pin that can seat against a valve seat for opening, closing, or modulating flow through the flow path through the valve body. In the illustrated embodiment, the valve member 18 includes an elongated stem portion that extends through the valve body 12 across the inlet-outlet flow path to an opposite end portion of the valve member 18. The end portion of the valve member may include suitable abutments or stops, such as shoulder portions or the like.

The power element 20 includes a housing 26 and a diaphragm 28 that is fixed in position by the housing between upper and lower portions of the housing. The diaphragm 28 may be fixedly attached, such as by welding or otherwise adhering, portions of the diaphragm to the housing 26. The diaphragm 28 is operatively coupled to the valve member 18, such as being directly or indirectly attached to a first side (e.g., underside) of the diaphragm 28. The diaphragm 28 may have any suitable structure and be made of any suitable material for enabling movement of the valve member 18 in response to force applied to the diaphragm 28. For example, the diaphragm 28 may be made of a thin sheet or sheets of material that are configured to flex or bow in response to a force applied to the diaphragm 28.

The thermal sensor 24 of the TEV 10 is operatively mounted to, or integrated with, the housing 26 of the power element 20, although the thermal sensor 24 also could be integrated with or operatively mounted to the valve body 18. The TEV 10 is configured such that changes in temperature of the sensing fluid in the sensing chamber of the thermal sensor 24 results in contraction or expansion of the sensing fluid which changes the pressure in the sensing chamber, and therefore the force applied to the diaphragm 28 of the power element 20. The changes in pressure cause the diaphragm 18 to move (e.g., flex or bow), which in turn exerts force on the valve member 18 to further open or further close the TEV 10. As shown, the TEV 10 may further include an adjustment mechanism 30, such as a spring-biased adjuster including a spring 32 and threaded pin 34, whereby the spring force combines with fluid pressure at the underside of that diaphragm for counteracting the pressure from the thermal sensor and thereby setting a desired control setpoint of the TEV 10.

Accordingly, the bulbless TEV 10 senses pressure and temperature of the system suction line 22 using the power element 20. The power element 20 reacts to changes in temperature and pressure by opening or closing the valve based on positioning of the valve member 18. The valve body 12 receives hot liquid refrigerant via the inlet 14. The refrigerant flows through an orifice in the valve body 12 and expands, and the amount of flow through the orifice is metered by the positioning of the valve member 18. This flow through the orifice causes expansion, and the temperature of the refrigerant thus becomes colder. The expanded refrigerant is then routed through the outlet 16 and to the heat exchanger 15, where the refrigerant gains temperature and is returned to the bulbless TEV 10 through the suction line 22 through the valve body 12 that operates as a suction line passage for flow to a compressor (not shown). The system optionally may include a fan to add airflow over the valve from the heat exchanger. The suction line 22 is fluidly isolated from the inlet and the outlet by the structure of the valve body. The power element 20 is mounted to the valve body 12 adjacent to the suction line 22 through the valve body so that the power element can sense and react to the pressure and temperature of the suction line as referenced above.

Referring to FIGS. 1 and 2, the valve body 12 of the bulbless TEV 10 thus defines the suction line 22, valve inlet 14, and valve outlet 16. The valve body 12 of the TEV is exposed to temperatures within the suction line 22, valve inlet 14, and valve outlet 16, which can all be at different temperatures, and also is exposed to the ambient temperature which also varies. A conventional valve body averages out these temperatures and conducts this heat to the power element 20. If temperature variations are not accounted for, this heat conduction could raise or otherwise affect the temperature of the power element 20, which can negatively affect the measurement made off the suction line 22, and, therefore, the power element 20 of the valve may position the valve member 18 to an incorrect position for superheat control. This could cause inefficiency of the system by allowing too much or too little refrigerant flow through the valve and may result in the valve over-correcting or hunting for the correct position of the valve member.

To address such issue, as shown in FIGS. 1 and 2 the valve body 18 further has or defines a thermal separation slot 40 that is incorporated within the valve body 18. The thermal separation slot 40 is positioned between the inlet 14, which receives the flow of hot refrigerant, and the suction line 22. The thermal separation slot 40 thermally separates the suction line from the hot liquid refrigerant that is flowing through the inlet 14. In this manner, the thermal separation slot 40 is positioned between the inlet and the suction line on an inlet side of the valve body to provide thermal separation of the suction line relative to the inlet. The thermal separation slot effectively decreases the amount of heat that is transferred from the inlet 14 to the suction line 22, and therefore also to the power element 20, thereby minimizing the propensity of the power element 20 to operate based on an incorrect temperature. As a result, the valve body 12 with the thermal separation slot 40 positioned between the inlet 14 and the suction line 22 on an inlet side of the valve body provides thermal separation of the power element 20 relative to the inlet 14. Further in this regard, the thermal separation provided by the thermal separation slot 40 also minimizes the effects of ambient temperature variation on the temperature at the power element.

As seen particularly in the perspective view of FIG. 2, the thermal separation slot 40 may be configured as a groove or recess that is formed integrally into the material of the valve body. The thermal separation slot may be formed into the valve body 12 by any suitable manufacturing process. Suitable processes include, for example, machining the thermal separation slot into the valve body, casting, or extruding a recess in the valve body 12.

Figure 3:
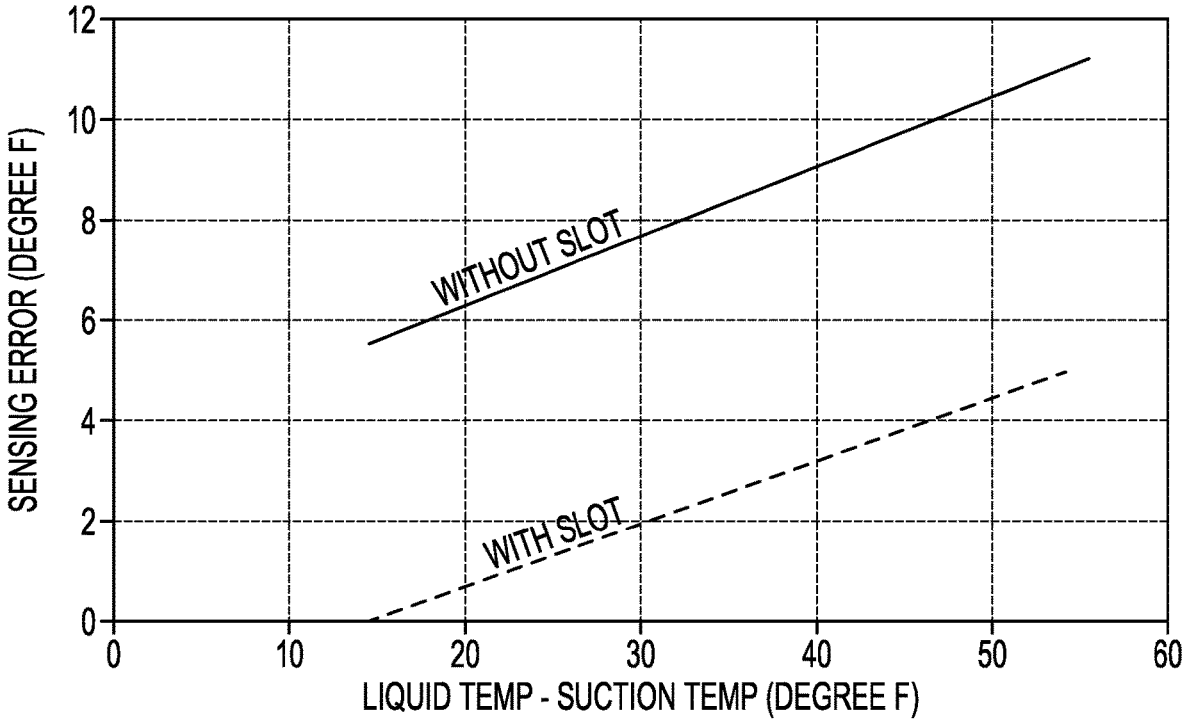
FIG. 3 is a drawing depicting a graphical performance of enhanced sensing with the presence of a thermal separation slot of the embodiment of FIGS. 1 and 2.

FIG. 3 is a drawing depicting a graphical performance of enhanced sensing with the presence of the thermal separation slot 40 of the embodiment of FIGS. 1 and 2. As referenced above, a principal cause of the power element sensing an incorrect temperature is the temperature difference between the incoming liquid temperature at the inlet 14 and the suction temperature at the suction line 22, thereby resulting in a sensing error and incorrect positioning of the valve member. As illustrated in FIG. 3, by adding the thermal separation slot 40, the sensing error was reduced by roughly 5° F., which is a significantly enhanced performance for proper positioning of the valve member.

Figure 4:
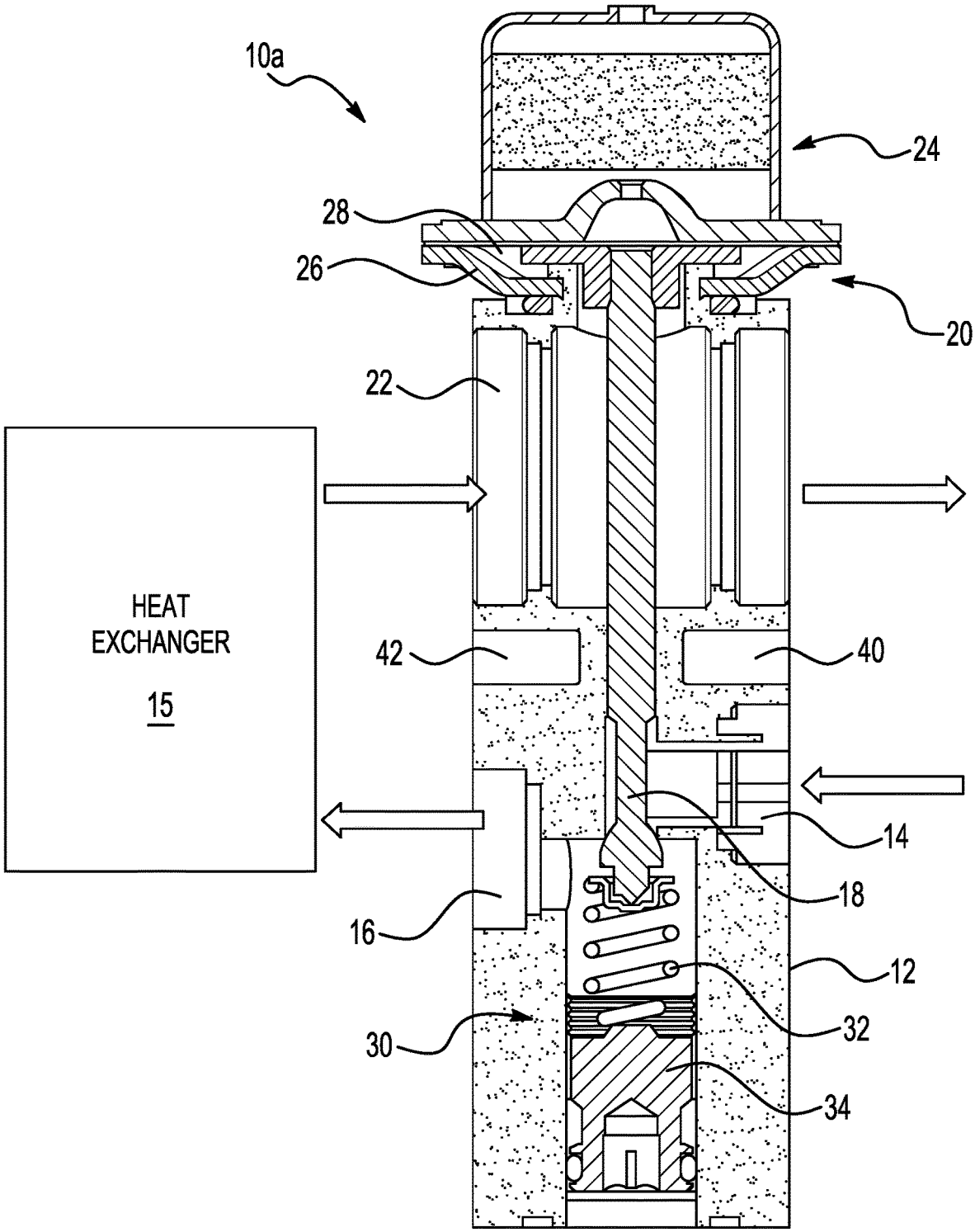
FIG. 4 is a drawing depicting a cross-sectional view of another exemplary embodiment of a bulbless TEV according to the present application.
Figure 5:
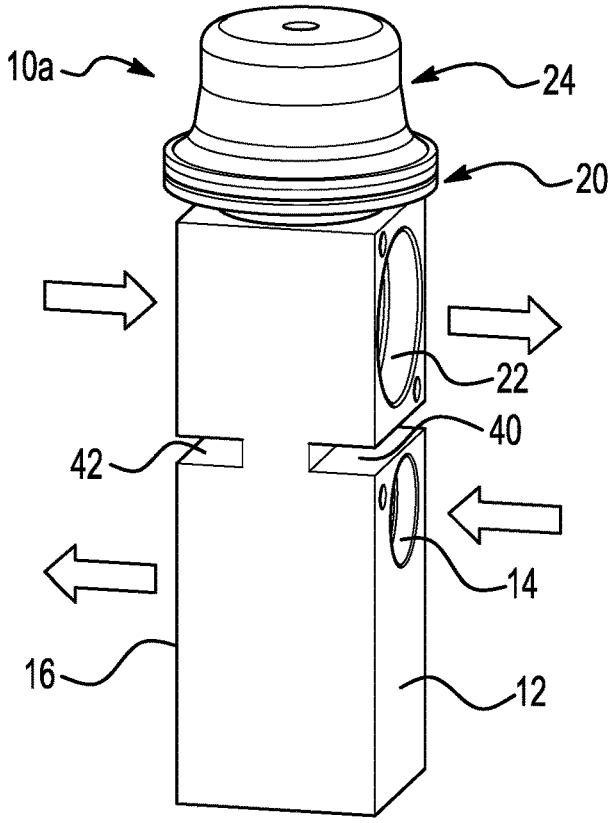
FIG. 5 is a drawing depicting a perspective view of the exemplary bulbless TEV of FIG. 4.

FIG. 4 is a drawing depicting a cross-sectional view of another exemplary embodiment of a bulbless TEV 10*a*, and FIG. 5 is a drawing depicting a perspective view of the exemplary bulbless TEV 10*a* of FIG. 4. The embodiment of bulbless TEV 10*a* of FIGS. 4 and 5 has comparable components as the embodiment of bulbless TEV 10 of FIGS. 1 and 2, and therefore like components are identified with like reference numerals in the various figures.

In the embodiment of FIGS. 4 and 5, the bubless TEV 10*a* includes a second thermal separation slot 42. The valve body 12 further has or defines the second thermal separation slot 42 that may be incorporated into the valve body 12 positioned between the suction line 22 and the valve outlet 16. In this manner, the second thermal separation slot 42 is positioned between the outlet and the suction line on an outlet side of the valve body to provide thermal separation of the suction line relative to the outlet. As a result, the valve body 12 with the additional second thermal separation slot 42 that is positioned between the outlet 16 and the suction line 22 on an outlet side of the valve body provides thermal separation of the power element 20 relative to the outlet 16. As referenced above, the hot refrigerant typically is received at the valve inlet 14 and expands and cools due to the operation of the valve member 18. Accordingly, the temperature of the refrigerant on the inlet side is elevated relative to the temperature on the outlet side. The first thermal separation slot 40 thus provides the gravamen of the thermal isolation or separation, but the second thermal separation slot 42 optionally can be added to provide some improved thermal isolation or separation as the temperature at the valve outlet 16 still may vary relative to the temperature of the suction line 22.

As seen particularly in the perspective view of FIG. 5, similarly as to the thermal separation slot 40, the second thermal separation slot 42 may be configured as a groove or recess that is formed integrally into the material of the valve body. The thermal separation slot 42 also may be formed into the valve body 12 by any suitable manufacturing process. Suitable processes again include, for example, machining the thermal separation slots into the valve body, casting, or extruding recesses in the valve body 12. In an exemplary embodiment, the first thermal separation slot 40 and the second thermal separation slot 42 may be configured as one contiguous thermal separation slot that wraps around the valve body from the inlet to the outlet. In another exemplary embodiment, the thermal separation slot and the second thermal separation slot are configured as one contiguous thermal separation slot that wraps around an entirety of the valve body.

Figure 6:
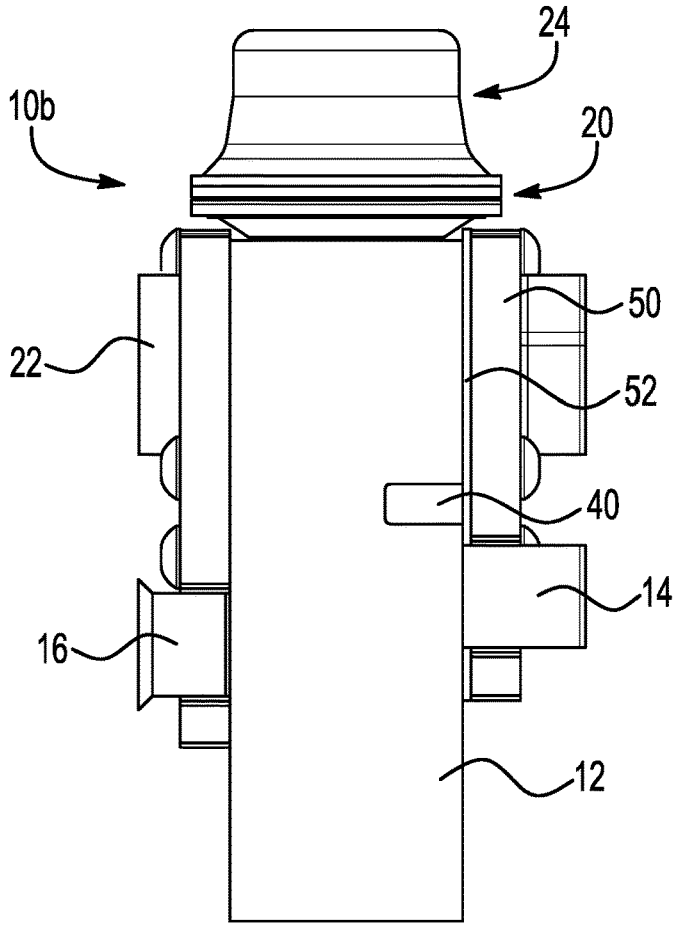
FIG. 6 is a drawing depicting a side view of another exemplary embodiment of a bulbless TEV according to the present application.
Figure 7:
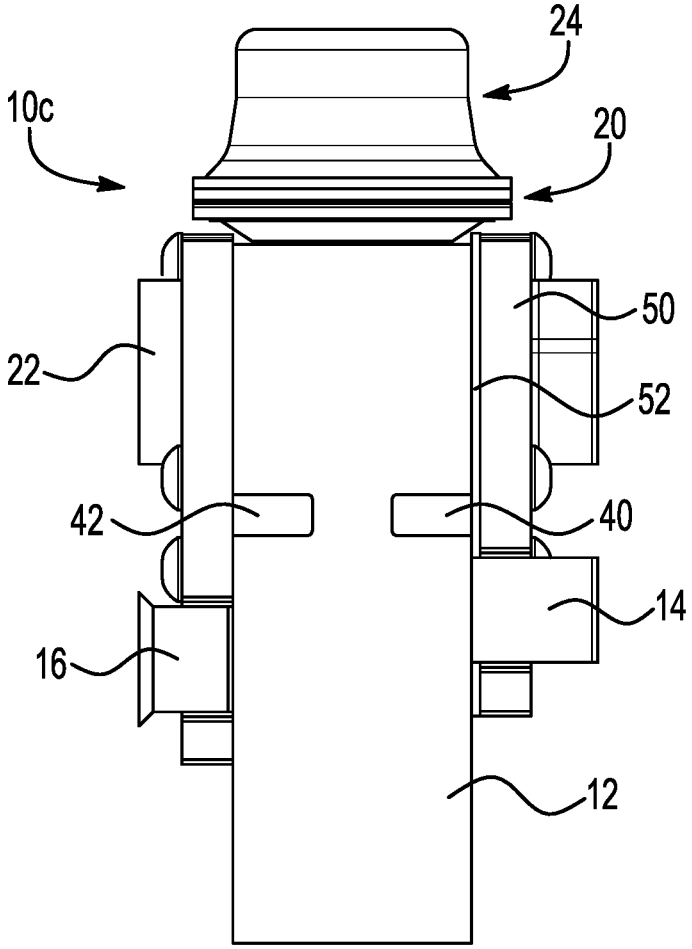
FIG. 7 is a drawing depicting a side view of another exemplary embodiment of a bulbless TEV according to the present application.

FIGS. 6 and 7 are drawings depicting a side view of additional exemplary embodiments respectively of a bulbless TEV 10*b* and 10*c*. To provide support and robustness where the refrigerant flow conduits connect to the valve body 12, the bubless TEV may include a flange portion 50 that is fixed to an outer side of the valve body 12. The flange portion 50 is mounted on the inlet side of the valve body 12 and is configured to receive fluid conduits fluidly connected to the inlet 14 and the suction line 22 on the inlet side of the valve body. In particular, the flange portion 50 defines passages through which the fluid conduits connect to the inlet 14 and the suction line 22 through the valve body.

Accordingly, the flange portion 50 may provide another pathway from which there may be varying temperature exposure to the valve body 12, which in turn may result in temperature variation conducted to the power element 20. To reduce the potential for heat conduction from the flange portion 50 to the valve body 18 in the inlet side, and ultimately to the power element 20, the bulbless TEV further may include a thermal gasket 52 positioned between the valve body 12 and the flange portion 50. In this manner, the thermal gasket 52 operates to provide thermal separation of the valve body 12 relative to the flange portion 50. The thermal gasket 52 may be made of any suitable material to provide the requisite thermal separation, such as for example being an elastomeric, thermoplastic, rubber, or comparable materials that are commonly used in the art for gaskets. The thermal gasket 52 may be used in either configuration of thermal separation slots, i.e., used with the embodiment of FIGS. 1 and 2 employing the single thermal separation slot 40 on the inlet side (TEV 10*b* of FIG. 6), or used with the embodiment of FIGS. 4 and 5 employing two thermal separation slots 40 and 42 with one each respectively on the inlet side and the outlet side (TEV 10*c* of FIG. 7).

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A bulbless thermostatic expansion valve comprising:

a valve body having an inlet and an outlet, and a suction line that is fluidly isolated from the inlet and the outlet;

a valve member movable relative to the valve body for controlling flow of an operating fluid through the valve body from the inlet to the outlet; and a power element mounted to the valve body adjacent to the suction line and that senses temperature and pressure of the suction line;

wherein the valve body has a thermal separation slot that is positioned between the inlet and the suction line on an inlet side of the valve body to provide thermal separation of the power element relative to the inlet.

2. The bulbless thermostatic expansion valve of claim 1, wherein the thermal separation slot is configured as a groove that is formed into the valve body.

3. The bulbless thermostatic expansion valve of claim 1, wherein the valve body has a second thermal separation slot that is positioned between the outlet and the suction line on an outlet side of the valve body to provide thermal separation of the power element relative to the outlet.

4. The bulbless thermostatic expansion valve of claim 3, wherein the second thermal separation slot is configured as a groove that is formed into the valve body.

5. The bulbless thermostatic expansion valve of claim 3, wherein the thermal separation slot and the second thermal separation slot are configured as one contiguous thermal separation slot that wraps around the valve body from the inlet side to the outlet side.

6. The bulbless thermostatic expansion valve of claim 3, wherein the thermal separation slot and the second thermal separation slot are configured as one contiguous thermal separation slot that wraps around an entirety of the valve body.

7. The bulbless thermostatic expansion valve of claim 1, further comprising:

a flange portion mounted on the inlet side of the valve body and that is configured to receive fluid conduits fluidly connected to the inlet and the suction line; and a thermal separation gasket that is positioned between the valve body and the flange portion to provide thermal separation of the valve body relative to the flange portion.

8. The bulbless thermostatic expansion valve of claim 3, further comprising:

a flange portion mounted on the inlet side of the valve body and that is configured to receive fluid conduits fluidly connected to the inlet and the suction line; and a thermal separation gasket that is positioned between the valve body and the flange portion to provide thermal separation of the valve body relative to the flange portion.

* * * * *